US005603578A

United States Patent [19]

Furuya

[11] Patent Number: 5,603,578

[45] Date of Patent: Feb. 18, 1997

[54] SERIAL PRINTER AND PRINTING METHOD THEREFOR

[75] Inventor: Masami Furuya, Kanagawa, Japan

[73] Assignee: Fuji Xerox Co., Ltd., Tokyo, Japan

[21] Appl. No.: 623,179

[22] Filed: Mar. 28, 1996

Related U.S. Application Data

[63] Continuation of Ser. No. 136,948, Oct. 18, 1993, abandoned.

[30] Foreign Application Priority Data

Oct. 21, 1992 [JP] Japan ..... 4-307523

[51] Int. Cl.[6] ..... B41J 19/76

[52] U.S. Cl. ..... 400/279; 400/582; 395/111

[58] Field of Search ..... 400/582, 706, 400/707.1, 708, 709.2, 279; 395/108, 111, 115, 116

[56] References Cited

U.S. PATENT DOCUMENTS

| | | | |
|---|---|---|---|
| 4,671,683 | 6/1987 | Ueno et al. | 400/708 |
| 4,889,439 | 12/1989 | Cook et al. | 400/706 |
| 5,074,691 | 12/1991 | Kira et al. | 400/708 |
| 5,128,858 | 7/1992 | Kitabata | 400/706 |
| 5,169,249 | 12/1992 | Kitabata | 400/706 |
| 5,235,351 | 8/1993 | Kuizumi | 400/126 |

FOREIGN PATENT DOCUMENTS

| | | |
|---|---|---|
| 334768 | 7/1989 | Japan . |
| 2-196672 | 8/1990 | Japan . |

*Primary Examiner*—John S. Hilten
*Attorney, Agent, or Firm*—Finnegan, Henderson, Farabow, Garrett & Dunner, L.L.P.

[57] ABSTRACT

A serial printer has a moving unit for relatively moving a printing unit and a printing medium in two directions orthogonal to each other, and a detecting unit for detecting a trailing edge of the printing medium. The printing unit and the printing medium are relatively moved in a fast scan direction to print on the printing medium print data of a printing width of the printing unit. The printing unit and the printing medium are then relatively moved in a slow scan direction by a fixed distance corresponding to the printing width of the printing unit. The printing operation is then repeated. The number of nonprint lines for a final printing width is calculated by the serial printer based on a position of the trailing edge of the printing medium detected by the detecting unit. The print data of the final printing width is printed so that print data corresponding to the number of nonprint lines is absent.

11 Claims, 8 Drawing Sheets

SERIAL PRINTER AND PRINTING METHOD THEREFOR

This application is a continuation of application Ser. No. 08/136,948, filed Oct. 18, 1993, now abandoned.

BACKGROUND OF THE INVENTION

1. Field of the Invention

The present invention relates to a serial printer for printing print data by relatively moving print means and print medium in two directions orthogonal to each other, and a printing method for such a serial printer. More particularly, the invention relates to a print control system capable of printing an image of good quality even at the last line.

2. Discussion of the Related Art

Many types of serial printers, such as printers of the dot-impact type, thermal transfer type, ink-jet type, and the like, have been developed and practically used. Among those serial printers, the ink-jet printer, which jets ink against a print medium or a sheet of print paper by utilizing heat generated by a heating member to perform a printing operation, is capable of printing an image at high density. In this respect, the ink-jet printer is a promising printer.

In a conventional serial printer, all of the dots of the print head are used for printing, and the quantity of feeding of the sheet of print paper is determined depending on a preset line pitch and print data.

The way of feeding a sheet of print paper in a conventional printer is shown in FIG. 5. As shown, the sheet is fed by line-to-line or line pitch every time the print head prints one line. For a large line pitch, the quantity of the sheet feed is large, and for a small line pitch, the quantity of the sheet feed is small. Where the quantity of the sheet feed is not uniform, an error of the sheet feed tends to occur. When the print progresses, feed errors are accumulated. Accordingly, there is the possibility that in the printing operation of the lines near to the last line, one or some lines cannot be printed. Thus, in the conventional technique, where the quantity of feeding of the sheet is not uniform or fixed, the sheet is irregularly fed, leading to deterioration of the print quality.

In the printer of the type where the drive nozzles are individually controlled, the circuit must be arranged in accordance with the number of drive nozzles. Mere increase of the number of nozzles is impractical in light of the number of dots per line. Further, it is not easy to increase the number of nozzles.

When the remaining print area of the sheet of the print paper is smaller than the total number of dots of the print head, the conventional serial printer does not print at the last line, discharges the sheet, and prints the remaining print data on the next sheet. Thus, no print is carried out for the end portion of the sheet. The print area on the sheet cannot be utilized fully.

Japanese Patent Unexamined Publication No. Hei. 2-196672 discloses such a technique that to print the last line of the area to be printed, only the nozzles corresponding to the number of lines to be printed are selectively driven. To this end, in printing the last line, the quantity of the sheet feed is altered so as to allow the sheet to be fed by a distance corresponding to the number of lines to be printed. For this reason, irregular sheet feed tends to occur in the printing operation of the last line. Further, the effective print area handled in this disclosed technique ranges up to the mid location at the most on the sheet, not to the end portion of the sheet. No description referring to the print for the end portion is found. The technique also ineffectively uses the sheet.

SUMMARY OF THE INVENTION

The present invention has been made in view of the above circumstances and has an object to provide a serial printer and a printing method therefor which realize an effective use of a sheet of the print paper without deteriorating the print quality and with a simple circuit construction.

To achieve the above object, the invention provides a serial printer including print means, first drive means for relatively moving the print means and a printing medium in a fast scan direction, second drive means for relatively moving the print means and the printing medium at a fixed pitch in a slow scan direction, primary storing means for storing print data containing line pitch data of a predetermined print line, and print control means for controlling driving operations of the first drive means, second drive means and print means in a manner that the print control means converts the line pitch data to dot data by calculation, stores the converted dot data as well as the print data into the primary storing means as developed dot data, and drives the print means according to the developed dot data.

Further, the invention provides a printing method for a serial printer having moving means for relatively moving printing means and a printing medium in two directions orthogonal to each other, and detecting means for detecting a trailing edge of the printing medium, the method including the steps of relatively moving the printing means and the printing medium in a first direction to print on the printing medium print data of a printing width of the printing means, relatively moving the printing means and the printing medium in a second direction by a distance predetermined based on the printing width of the printing means, and repeating the printing operation, calculating the number of nonprint lines for a final printing width based on a position of the trailing edge of the printing medium detected by the detecting means, and printing the print data of the final printing width in a state that print data corresponding to the number of nonprint lines is absent.

BRIEF DESCRIPTION OF THE DRAWINGS

The accompanying drawings, which are incorporated in and constitute a part of this specification, illustrate an embodiment of the invention and, together with the description, serve to explain the objects, advantages and principles of the invention. In the drawings.

DETAILED DESCRIPTION OF THE PREFERRED EMBODIMENTS

Figure 1:
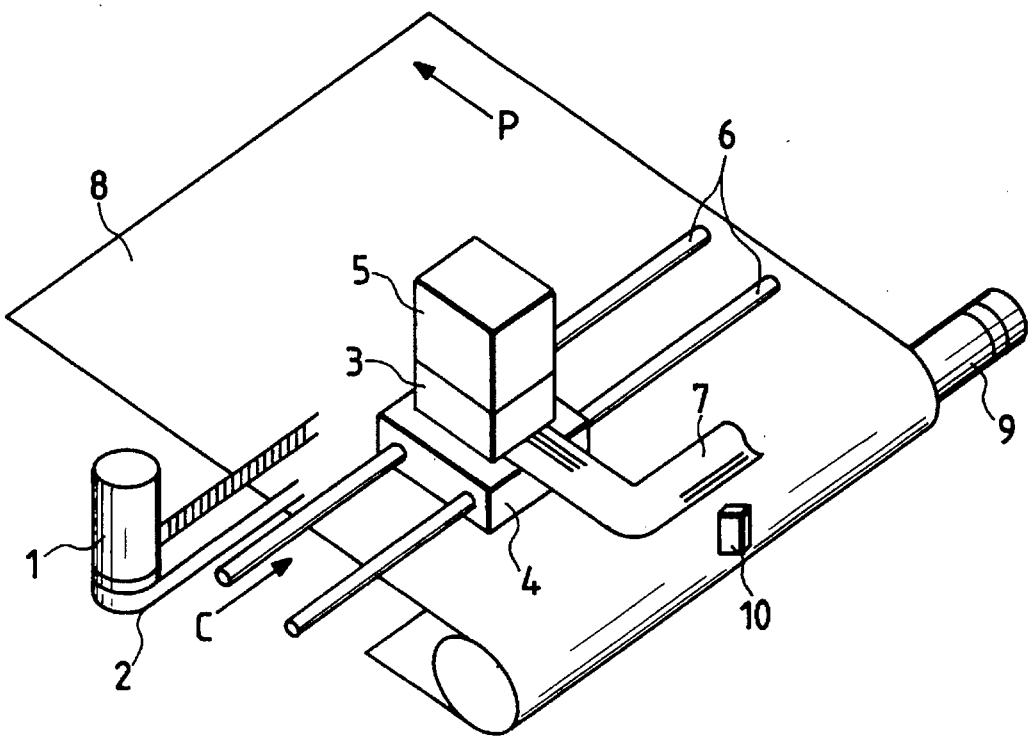
FIG. 1 is a perspective view showing an ink jet printer as an embodiment of the present invention.
Figure 2:
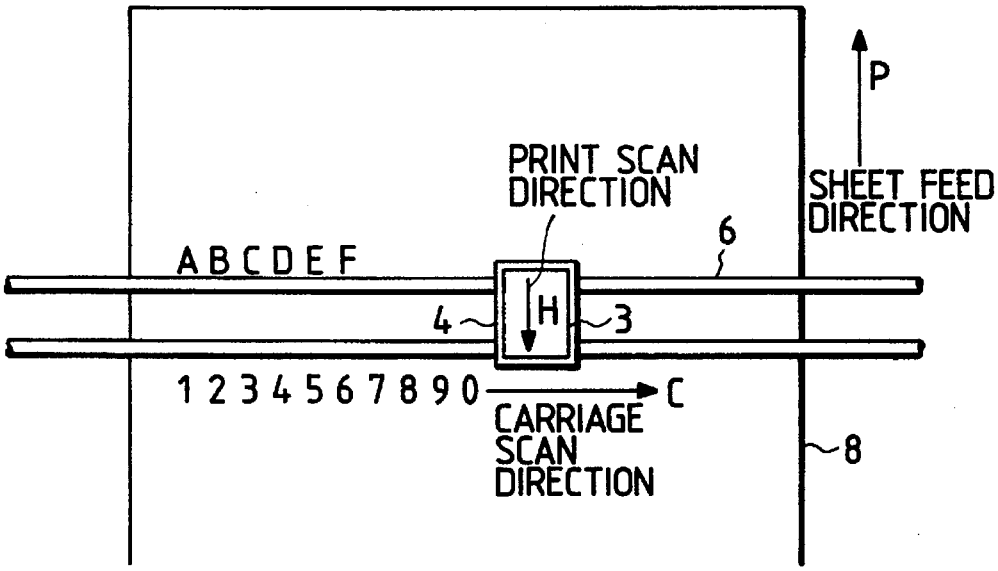
FIG. 2 is a plan view showing the printer of FIG. 1.

FIG. 1 is a perspective view showing an ink jet printer as an embodiment of the present invention. FIG. 2 is a plan view showing the printer of FIG. 1. In those figures, reference numeral 1 designates a carriage drive motor; 2, a timing belt; 3, a print head; 4, a carriage; 5, an ink tank; 6, paired carriage guide rails; 7, a cable; 8, a sheet of print paper; 9, a feed motor; and 10, a sheet sensor.

The carriage 4 having the print head 3 mounted thereon is reciprocatively moved along the carriage guide rails 6 in the fast scan direction. In the fast scan movement, the forward movement of the carriage is indicated by the direction of an arrow C, and the backward movement, by its reverse direction. The carriage 4 is moved by the timing belt 2 to be driven by the carriage drive motor 1. The print head 3 has a plurality of nozzles contained therein. Droplets of ink are jetted out of the nozzles against the sheet of print paper 8, thereby printing an image on the sheet. The printing operation is basically carried out in the direction of an arrow H shown in FIG. 2. The cable 7, coupled with the print head 3, is used for feeding current to the heaters of the nozzles and transferring head drive signals to a drive circuit. The ink tank 5, attached to the print head, supplies ink to the head. Upon completion of one line print, the feed motor 9 drives a feed roll and an exit roll, both being not shown, so that the sheet 8 is moved in the direction of an arrow P, thereby executing the slow scan operation. The sheet sensor 10 senses presence or absence of the sheet 8.

Figure 3:
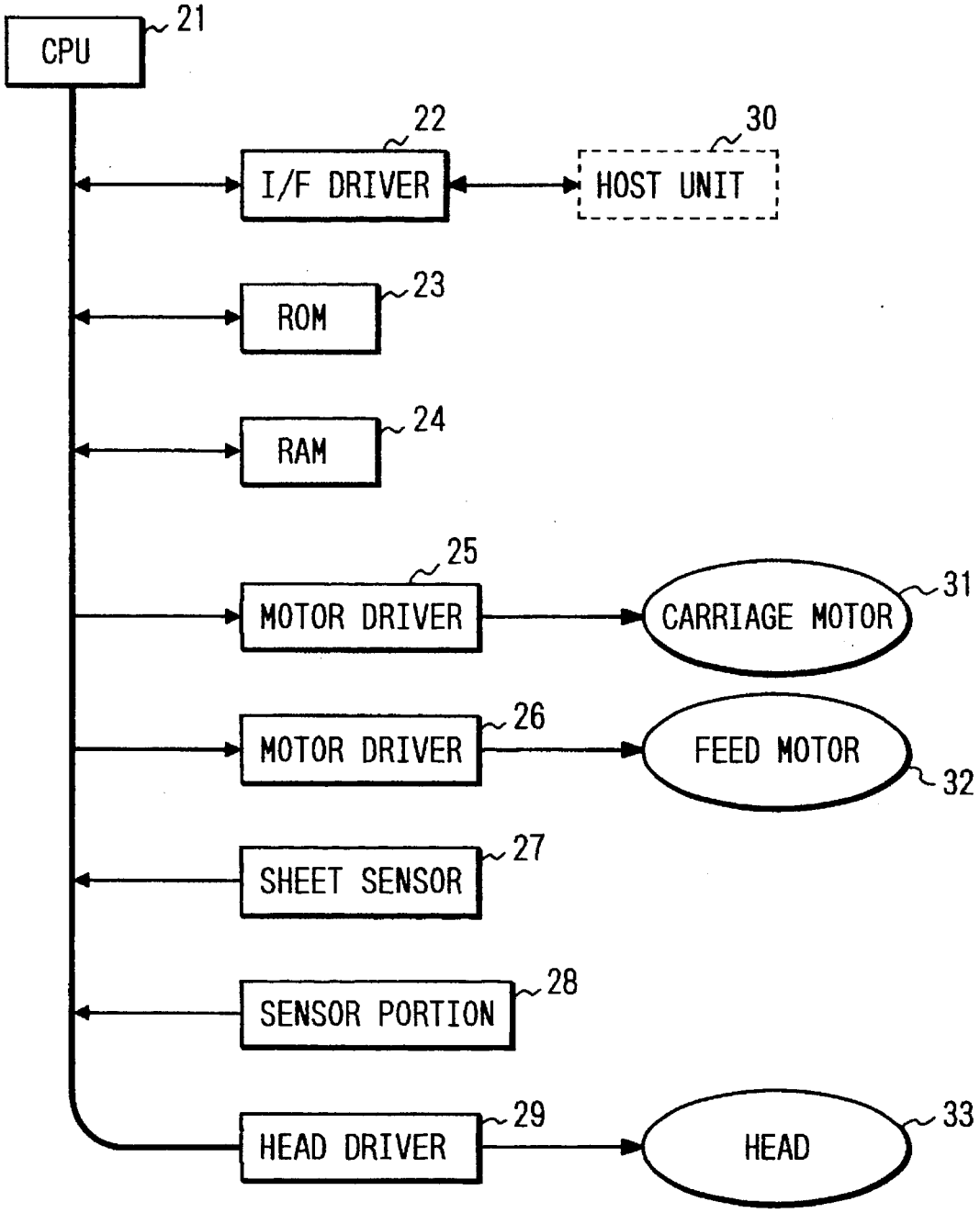
FIG. 3 is a block diagram showing a control system of the printer of FIG. 1.

FIG. 3 is a block diagram showing a control system of the printer of FIG. 1. In the figure, reference numeral 21 designates a CPU; 22, an I/F driver; 23, a ROM; 24, a RAM; 25 and 26, motor drivers; 27, a sheet sensor; 28, a sensor portion; 29, a head driver; 30, a host unit; 31, a carriage motor; 32, a feed motor; and 33, a print head.

The CPU 21 controls the related portions in the printer in accordance with control programs and data, which are stored in the ROM 23, or data signals from the sheet sensor 27 and the sensor portion 28. In the control operation, the RAM 24 is used. The CPU 21 is connected through the I/F driver 22 to the host unit 30, such as a computer. The CPU 21 receives print data from the host unit 30 and stores it in the RAM 24. Further, the CPU 21 decodes instructive signals, such as command signals, from the host unit 30, and controls the printing operation. The RAM 24 contains a work area for the CPU 21 and a memory area for storing print data of one line. In other words, the print data of one line is linearly developed into the memory area. The motor drivers 25 and 26, and the head driver 29 control the carriage motor 31, the feed motor 32, and the head 33 respectively under control of the CPU 21. The sheet sensor 27 senses presence or absence of a sheet of print paper. The sensor portion 28 senses temperature, quantity of ink, and the like and transfers the sensed data signals to the CPU 21.

Figure 4:
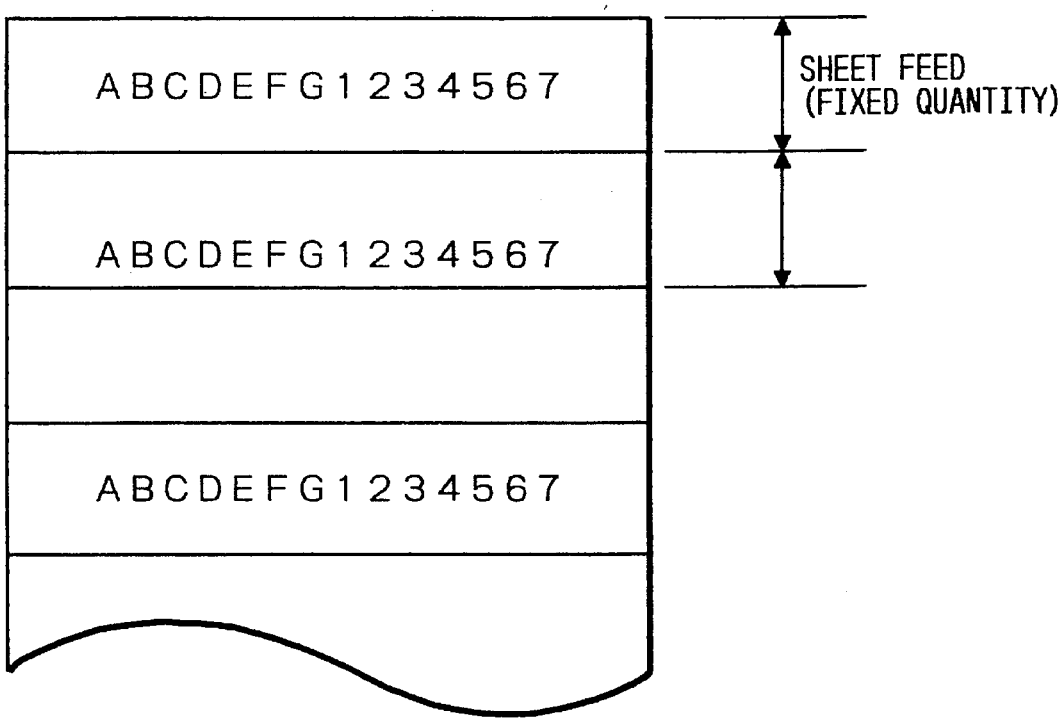
FIG. 4 is an explanatory diagram for explaining a sheet feed in the embodiment.

Next, the printing method according to the embodiment of the present invention will be described. FIG. 4 is an explanatory diagram for explaining the way of feeding a sheet of print paper in the embodiment.

Figure 5:
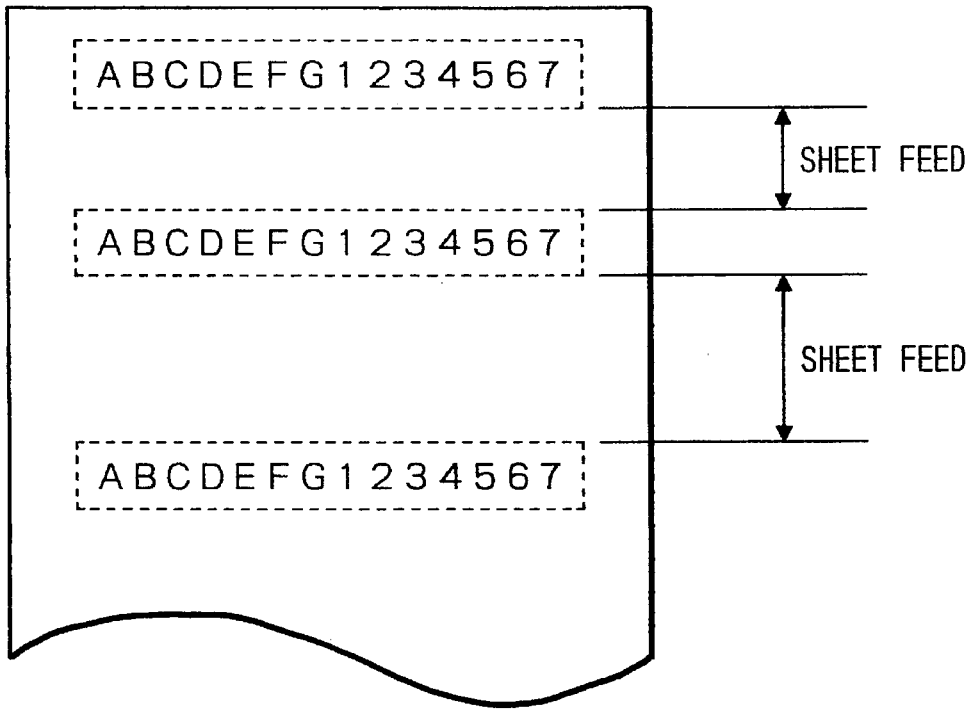
FIG. 5 PRIOR ART
FIG. 5 is an explanatory diagram for explaining a sheet feed in a conventional printer.

As already referred to in connection with FIG. 5, in the conventional sheet feeding method, the quantity of sheet feed is varied according to the print instruction data issued from the host computer or the like. Accordingly, an error tends to occur in the quantity of sheet feed. When the printing operation progresses, feed errors are accumulated. Thus, there is the possibility that in the printing operation of the lines near to the last line, one or some lines cannot be printed on the same sheet.

In the present invention, as shown in FIG. 4, the quantity of sheet feed is set at a fixed value irrespective of the print instruction data from the host computer or the like. Accordingly, the error of the sheet feed is minimized, and the printing area on the sheet can be fully utilized. In addition, when no print data is present for the distance of the sheet feed, the printer does not operate for printing, but feeds the sheet by a fixed distance, thereby improving the through-put of printing.

Figure 6:
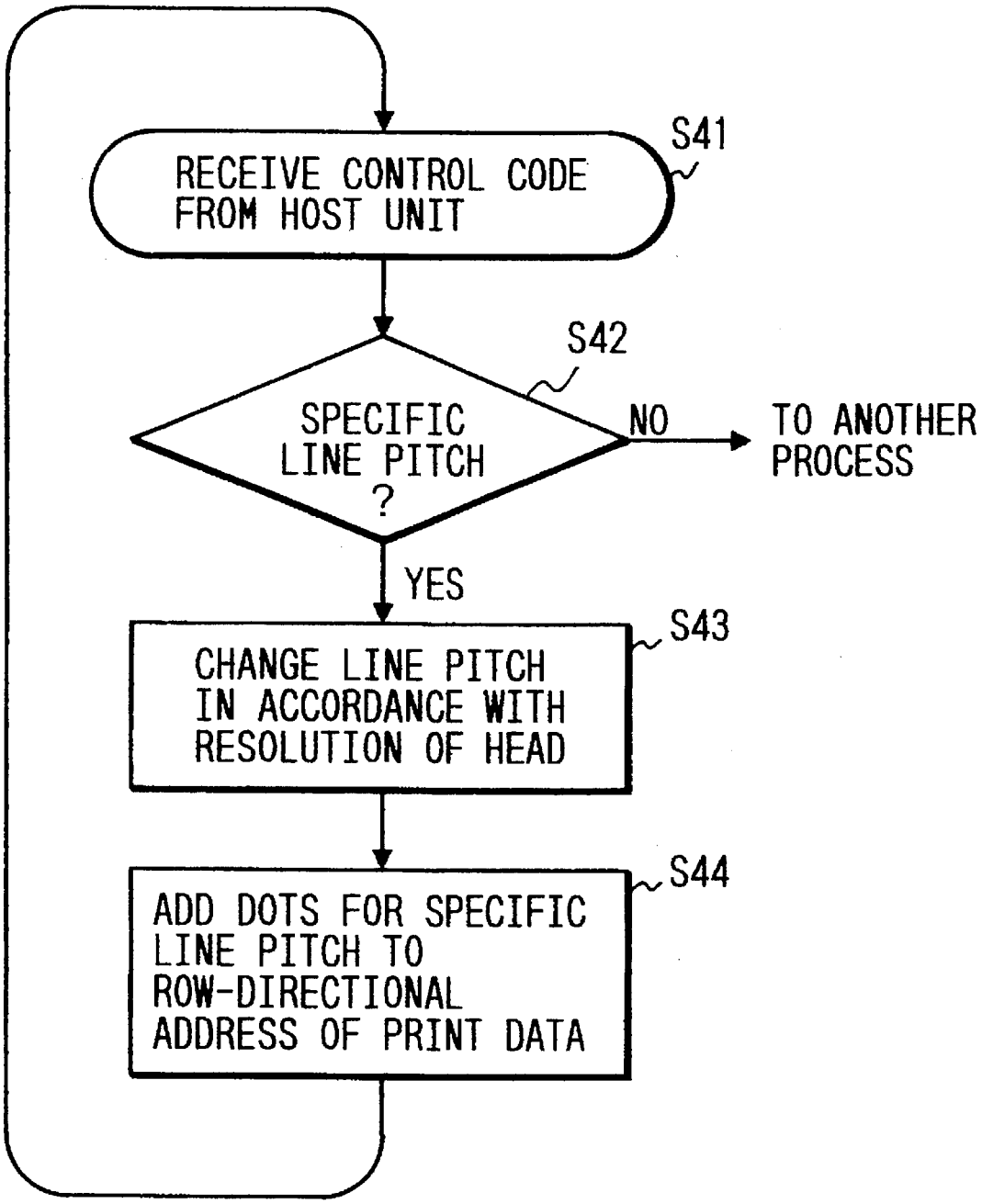
FIG. 6 is a flowchart showing a flow of a process carried out in the control system when the system receives an instruction of a specific line pitch from a host unit.

FIG. 6 is a flowchart showing a flow of a process carried out in the control system when the system receives an instruction of a specific line pitch from the host unit. As described above, the quantity of the sheet feed is set at a fixed value. Accordingly, the position of the print data within the RAM 24 is varied according to the line pitch instructed by the host unit. To be more specific, in step S41, the CPU 21 receives data from the host unit 30 through the I/F driver 22, and picks up a control code and a command from the received data and analyzes them. In step S42, the CPU 21 checks as to whether or not the received data designates a specific line pitch. If a specific line pitch is not designated, the CPU executes the process by another instruction. If a specific line pitch is designated, the CPU, in step S43, exactly corrects the specific line pitch according to the resolution of the print head, and calculates the number of dots for the specific line pitch. In step S44, the CPU adds the calculated dots to the row-directional address of the print data, thereby to control the line pitch. Thus, the line pitch data received from the host unit 30 is analyzed by the CPU 21, and the address of the print data is varied. As a result, when print data is developed into the RAM 24 having the memory area capable of storing at least the data of the sheet feed width, the line pitch is corrected. In this way, the print data of the varied line pitches can be printed without varying the sheet feed quantity.

Figure 7:
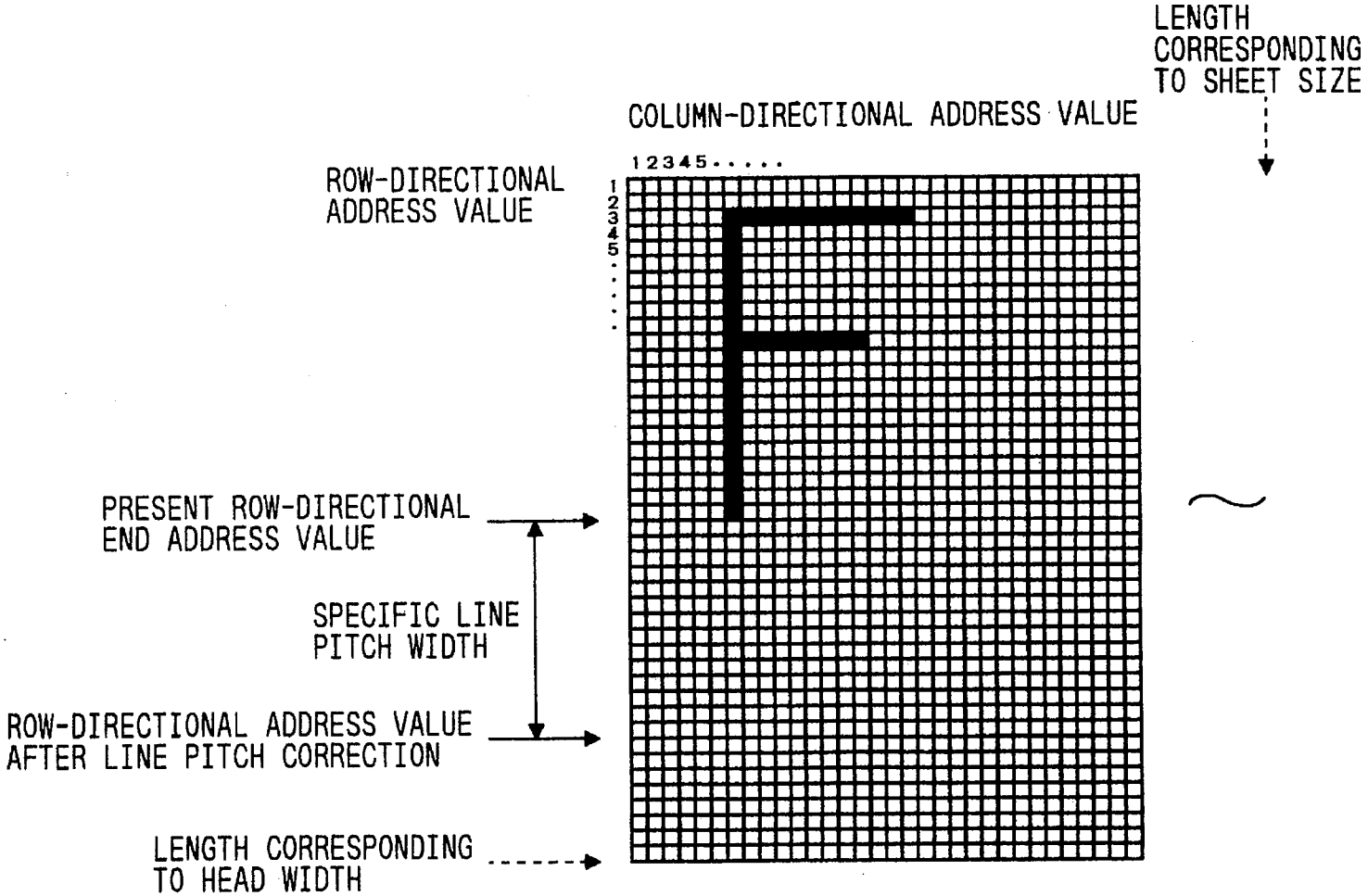
FIG. 7 is an explanatory diagram for explaining a line pitch.

FIG. 7 is an explanatory diagram for explaining a line pitch in the RAM.

The bits or words corresponding to the dots in the RAM 24 are specified by row-directional and column-directional address values. In the case of FIG. 7, a character "F", developed into dots, is stored in the RAM 24. It is assumed now that the present row-directional end address corresponds to the bottom of the character "F" at the time of completion of developing the print data of one line including the character "F" into dots. When the printer system receives data indicative of an instruction of a specific line pitch from the host unit 30, the system calculates the number of dots for the specific line pitch, and adds the number of dots to the present row-directional end address value, thereby to obtain the row-directional address value after the line pitch correction. The thus corrected row-directional address value is used as the row-directional start address value when the print data of the next one line is developed into dots. When the corrected row-directional address value exceeds the size of the print head width, the system considers that the development of a portion of the print data to be printed by one scan into dots has been completed, and successively transfers the developed print data to the head, which then prints the data actually.

Figure 8:
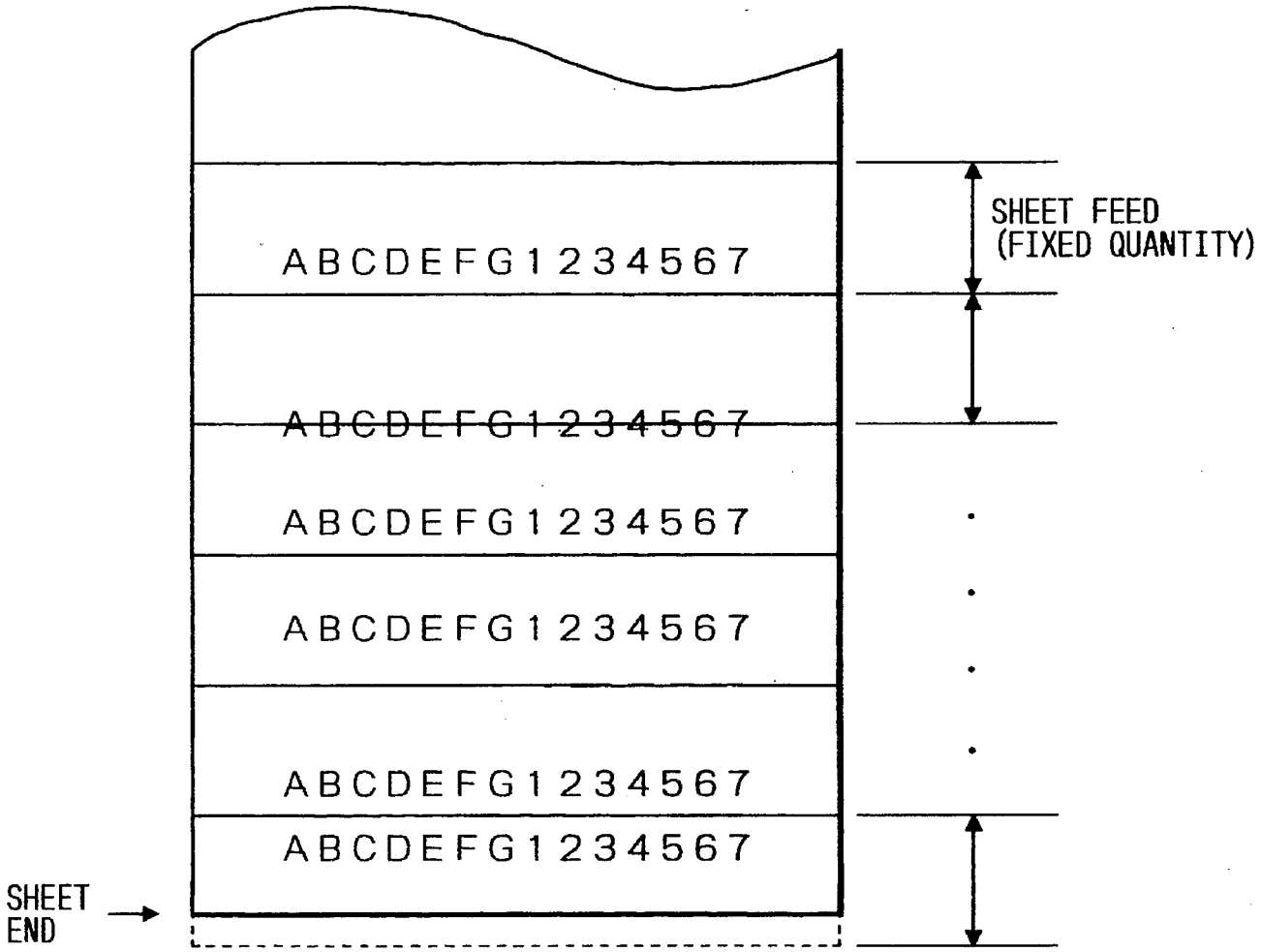
FIG. 8 is an explanatory diagram for explaining how the last line is printed in the embodiment.

FIG. 8 is an explanatory diagram for explaining how the last line is printed in the embodiment of the invention.

In the printing method of the invention, the printing operation of a fixed width is performed, the sheet is fed by a fixed distance corresponding to the print width, and the sequence of the printing and feeding operations is repeated. Accordingly, when the print data of the last line is printed, the remaining print area on the sheet is sometimes smaller than the head width. In such an instance, zeros are written into the memory area corresponding to the area in excess of the print area of the sheet, thereby inhibiting the head from jetting ink therefrom. Under this control, the head is driven as in the normal printing operation, but the print data is printed only on the area within the print area on the sheet. The judgement as to whether or not the present line is the last line is made by the sheet sensor 27. The distance between the sheet sensor 27 and the head is previously determined. Therefore, the last line and the print width of the last line can be predictively calculated using the sheet feed timing and the sheet end signal from the sheet sensor 27. The results of the calculation are used for the print control of the last line. The printing operation within the print area is ensured by such a print control. The print control can be realized by a simple head nozzle control.

Figure 9:
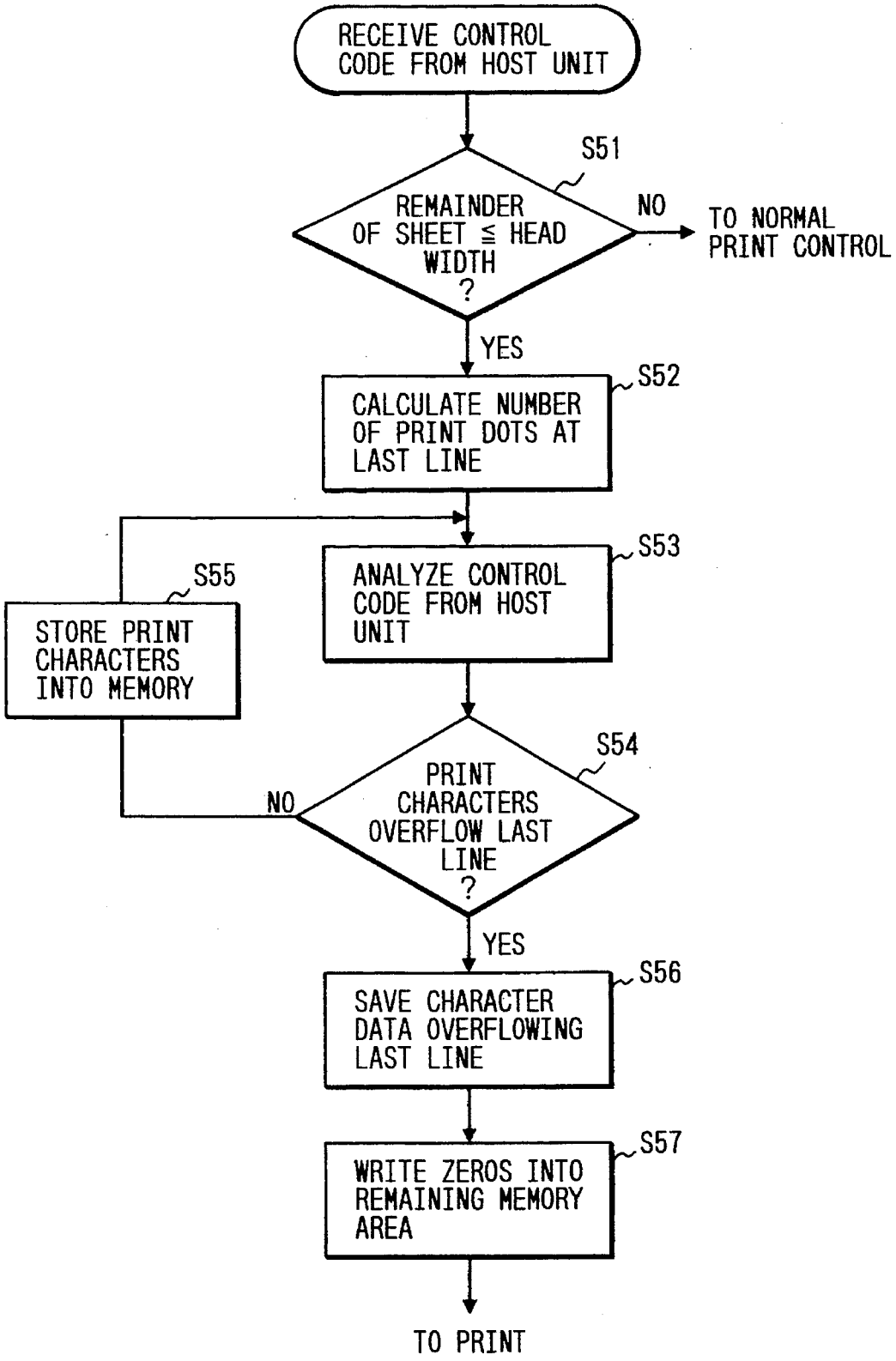
FIG. 9 is a flowchart showing a control flow carried out by the control system when the last line is printed.

FIG. 9 is a flowchart showing a control flow carried out by the control system when the last line is printed.

When the control system receives a control code from the host unit 30, the control system, in step S51, compares the remaining print area on the sheet with the width of the head. If the remaining print area is larger than the head width, the control system carries out the normal print control. Also when the sheet sensor 27 senses the sheet, the normal print control is carried out. When the print area is smaller than the head width, the control system decides that the next line is the last line, and advances to step S52. In this step, the control system calculates the number of dots allowed to be printed at the last line, using the size of the remaining print area of the sheet. In step S53, the control system analyzes the control code received from the host unit 30. In step S54, the control system checks whether or not the characters to be printed are within the area of the last line. If the characters are within the area, the control system develops the character data into dots in the RAM 24 in step S55. If the character data overflows the last line area (that is, it cannot be developed into dots in the RAM), the character data is printed at the first line on the next page. More specifically, whether or not the character data to be printed is within the area of the last line is checked. If impossible, the control system, in step S56, saves temporarily the character data overflowing the last line, in a buffer memory, and in step S57 writes zeros into the remaining memory area. Then, the control system enters the actual print mode.

The printed sheet is discharged from the printer and a new sheet is fed to the printer. The dot image overflowing the print area on the old sheet is printed at the first line on the new sheet. In this embodiment, the data saved in the buffer memory when the last line data was developed into dots is transferred to the dot image area, again.

Figure 10:
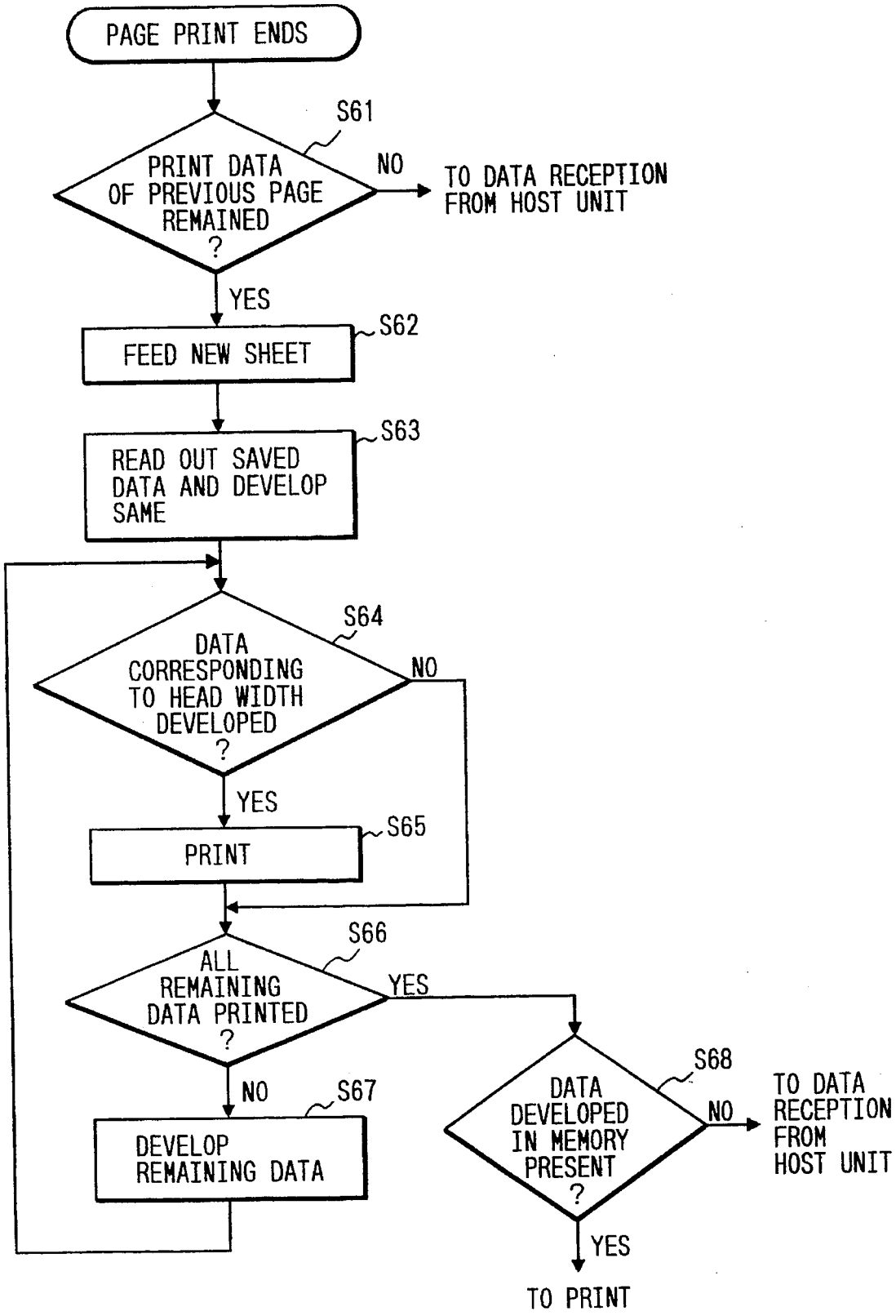
FIG. 10 is a flowchart showing a control flow by the control system when the last line data cannot be developed into a RAM of the system.

FIG. 10 is a flowchart showing a control flow by the control system when the last line data overflows the area of the last line.

After the printing operation of one page is completed, the control system, in step S61, checks whether or not the character data overflowing the sheet of the previous page (remaining data) is present. If the remaining data is absent, the control system receives the data from the host unit 30. If the remaining data is present, the control system in step S62 causes the related portion of the printer to feed a new sheet of print paper, and in step S63 reads the saved character data from the buffer memory and develops the data into dots in the RAM 24. In step S64, the control system checks whether or not the data corresponding to the head width has been developed. If it is developed, the control system in step S65 causes the printer to print the characters. If the data has not been developed yet, the control system jumps to step S66. In step S66, the control system checks whether or not the remaining data in the previous page has been completely printed. If it has not been printed yet, the control system in step S67 develops the remaining data into dots in the RAM 24, and returns to the step S64. If the remaining data has been completely printed, the control system in step S68 checks whether or not the developed data is present in the RAM 24. If the data is present, the printing operation is performed. If the data is absent, the control system receives the data from the host unit 30.

In the embodiment description, the sheet is moved in the slow scan direction. If required, the head, in lieu of the sheet, may be moved in the same direction. Further, while the present invention is applied to the ink jet printer, the same may be applied to any other printer of the serial type.

As seen from the foregoing description, in the invention, the quantity of sheet feed is set at a fixed value. The sheet is always fed at this feed quantity in the slow scan direction. Accordingly, the error of the sheet feed is minimized, and the printing operation in the area near to the end portion of the sheet is reliably carried out. The effective print area on the print paper can be fully utilized. No irregular feed takes place in the printing operation of the last line. The resultant image is of good quality.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A serial printer comprising:

print means for printing data;

first drive means for relatively moving said print means and a printing medium in a fast scan direction;

second drive means for relatively moving said print means and said printing medium at a fixed pitch in a slow scan direction;

primary storing means for storing print data containing line pitch data of a predetermined print line; and print control means for controlling during operations of said first drive means, second drive means and print means, said print control means including means for converting the line pitch data to dot data, adding the converted dot data and the print data to obtain corrected row-directional data, and storing said row-directional data in said primary storing means as developed dot data and means for driving said print means according to the developed dot data.

2. The serial printer according to claim 1, further comprising detecting means for detecting a trailing edge of the printing medium, calculating means for calculating the number of nonprint lines for a final printing width based on a position of the trailing edge of the printing medium detected by said detecting means, buffer memory means for temporarily storing print data corresponding to the number of nonprint lines, and means for emptying a memory area of said primary storing means for the print data corresponding to the number of nonprint lines.

3. The serial printer according to claim 2, wherein said emptying means writes zeros into the memory area of said primary storing means for the print data corresponding to the number of nonprint lines.

4. The serial printer according to claim 1, wherein said print means includes a print head for jetting droplets of ink against the printing medium, and an ink tank for supplying ink to said print head.

5. The serial printer according to claim 1, wherein said first drive means includes a carriage having said print means mounted thereon and movable along a pair of guide rails, a timing belt connected to said carriage, and a motor for driving said timing belt to move said carriage.

6. The serial printer according to claim 1, wherein said second drive means includes a feed motor for feeding the printing medium.

7. The serial printer according to claim 1, wherein said print control means includes a central processing unit.

8. The serial printer according to claim 1, wherein said primary storing means includes a random access memory.

9. A printing method for a serial printer having moving means for relatively moving printing means and a printing medium in two directions orthogonal to each other, and detecting means for detecting a trailing edge of the printing medium, said method comprising the steps of:

relatively moving said printing means and said printing medium in a first direction to print on the printing medium print data of a printing width of said printing means;

relatively moving said printing means and said printing medium in a second direction by a distance predetermined based on the printing width of said printing means, and repeating a printing operation;

calculating a number of nonprint lines for a final printing width based on a position of the trailing edge of the printing medium detected by said detecting means; and printing the print data of the final printing width in a state that print data corresponding to the number of nonprint lines is absent.

10. The printing method according to claim 9, further comprising the step of temporarily storing the print data corresponding to the number of nonprint lines in a buffer memory, before said printing step.

11. The printing method according to claim 10, further comprising the steps of discharging the printing medium from the serial printer, feeding a new printing medium to the serial printer, and printing the print data stored in the buffer memory at a first line on the new printing medium, said three steps being executed after said printing step.

* * * * *